United States Patent [19]

Louis

[11] 4,406,591

[45] Sep. 27, 1983

[54] ELECTROMAGNETIC FLUID PUMP

[76] Inventor: Anthony Louis, 437 Grinnell Dr., Burbank, Calif. 91501

[21] Appl. No.: 225,962

[22] Filed: Jan. 19, 1981

[51] Int. Cl.[3] ..... F04B 43/04

[52] U.S. Cl. ..... 417/363; 417/413

[58] Field of Search ..... 417/412, 413, 363, 472, 417/473

[56] References Cited

U.S. PATENT DOCUMENTS

| | | | |
|---|---|---|---|
| 2,471,796 | 5/1949 | Thiberg | 417/413 |
| 2,930,324 | 3/1960 | Toulmin | 417/413 |
| 2,942,772 | 6/1960 | Buchanan . | |
| 3,029,743 | 4/1962 | Johns . | |
| 3,066,611 | 12/1962 | Schwartmann et al. | 417/413 |
| 3,539,276 | 11/1970 | Matsuura | 417/413 |
| 3,572,980 | 3/1971 | Hollyday | 417/413 |
| 3,671,151 | 6/1972 | Duke et al. . | |
| 3,842,440 | 10/1974 | Karlson | 417/412 |
| 4,086,036 | 4/1978 | Hagen et al. . | |
| 4,154,559 | 5/1979 | Enomoto . | |
| 4,170,439 | 10/1979 | Hase . | |

*Primary Examiner*—Richard E. Gluck
*Assistant Examiner*—Peter M. Cuomo
*Attorney, Agent, or Firm*—Fulwider, Patton, Rieber, Lee & Utecht

[57] ABSTRACT

An electromagnetic fluid pump comprising an electromagnet motor unit for producing a magnetic field of reversing polarity to drive a fluid pump unit to pump fluid such as air. The fluid pump unit comprises a generally cup-shaped pump casing having its open end closed by a flexible diaphragm to define a fluid pumping chamber. A permanent magnet is mounted on the diaphragm, and the pump unit is mounted directly on the electromagnet motor unit with the permanent magnet and the electromagnet motor unit positioned at opposite ends of the fluid pumping chamber. In operation, the reversing magnetic field alternately repels and attracts the permanent magnet to displace the diaphragm to expand and contract the volume of the fluid pumping chamber. Expansion of the fluid pumping chamber draws fluid into the chamber through an inlet port including a one-way valve, and contraction of the fluid pumping chamber expels the fluid from the chamber through an outlet port including a one-way valve. In one alternative embodiment, the pump casing and the motor unit are movably mounted in a pump housing for reciprocating movement toward and away from the reciprocating permanent magnet to increase pump output, whereas in another alternative embodiment two of the fluid pumps are connected back-to-back for relatively vibration-free reciprocation of their permanent magnets in equal and opposite directions.

36 Claims, 7 Drawing Figures

ELECTROMAGNETIC FLUID PUMP

BACKGROUND OF THE INVENTION

This invention relates generally to fluid pumps. More specifically, this invention relates to an improved electromagnetic fluid pump for pumping a fluid such as air for use, for example, in the aeration of water in an aquarium.

Fluid pumps in general are well known in the art and typically comprise a driven pump element for drawing a desired fluid through a pump inlet into an internal pumping chamber, and for expelling the fluid under pressure from the pumping chamber through a pump outlet. Such fluid pumps are provided in a wide variety of sizes, shapes, and constructions, and they are used for pumping a virtually infinite variety of liquid and gaseous fluids, such as water, air, and the like.

In some environments, it is desirable to provide a relatively simple and inexpensive fluid pump for pumping a fluid such as air at a relatively low pressure and flow rate. One such environment comprises, for example, an aquarium wherein it is necessary to pump air into aquarium water to aerate the water to sustain aquatic life. However, since the aquarium typically is maintained in a home or apartment by an individual such as a hobbyist, it is highly desirable for the pump to be designed for quiet operation and relatively long life. Moreover, in the event of pump failure, it is further desirable for the pump to be quickly, easily, and inexpensively repairable, even by the owner.

In the prior art, a wide variety of fluid pumps have been designed for use in an aquarium environmment. Many such fluid pumps have comprised so-called diaphragm pumps wherein a flexible diaphragm defines one wall of an internal pumping chamber, and this diaphragm is reciprocated by a direct mechanical drive to draw air into the pumping chamber and then to expel the air from the chamber. See, for example, U.S. Pat. No. 4,086,036. However, these direct drive diaphragm pumps are typically relatively complex and expensive in construction, and they include a number of moving mechanical components which sometimes are relatively noisy in operation. Moreover, these moving mechanical components are susceptible to periodic failure, and they are not easily or inexpensively repaired or replaced.

Other fluid pumps for use in an aquarium environment have been proposed in the form of diaphragm pumps including a reciprocating diaphragm driven indirectly by an electromagnet. In some of these pumps, the diaphragm is connected to a pivot arm which is mechanically reciprocated by an electromagnet, such as those shown and described in U.S. Pat. Nos. 3,671,151; 4,154,559; and 4,170,439. In other pumps, polarized ceramic diaphragms are reciprocated by an electromagnet, such as that shown and described in U.S. Pat. No. 3,029,743. Alternately, a flexible diaphragm is provided with a metal armature which is reciprocated by an electromagnet to operate relatively complex valving components, such as that shown and described in U.S. Pat. No. 2,942,772. However, in all of these pump arrangements, the moving mechanical components tend to be relatively noisy in operation and are subject to periodic failure. In the event of failure, the components are not easily or inexpensively repaired or replaced by the individual.

A primary aspect of the present invention is to provide an improved fluid pump which is of relatively inexpensive and simplified construction, which is designed for long life and quiet operation, and which is easily and inexpensively repaired in the event of pump failure.

SUMMARY OF THE INVENTION

The electromagnetic fluid pump of this invention is of very simple construction comprising relatively simple and inexpensive components and a minimum number of moving parts which are very quiet in operation and have long operating life and, if repairs are needed, are very simple and inexpensive to service. Specifically, the pump of the invention comprises an electromagnet motor unit including an electromagnet for producing a reversing magnetic field to drive a fluid pump unit including a pump casing and a flexible diaphragm defining a fluid pumping chamber. A permanent magnet is carried by the flexible diaphragm and is alternately repelled and attracted by the magnetic field to displace the diaphragm to expand and contract the pumping chamber. Expansion and contraction of the pumping chamber respectively draws in and expels fluid through inlet and outlet ports controlled by oppositely acting one-way fluid valves.

In the presently preferred embodiments shown herein, the pump casing cooperating with the diaphragm to define the pump chamber is in the form of a plastic cup having a closed bottom wall mounted directly against the magnetic poles of the electromagnet. The diaphragm is mounted over an opposite, open end of the cup to enclose the pumping chamber, and the permanent magnet is carried by the diaphragm within the pumping chamber. Since the plastic bottom wall is highly pervious to magnetic flux, the permanent magnet and the electromagnet motor unit interact to reciprocate the diaphragm rapidly into and out of the pumping chamber, thereby drawing fluid into the pumping chamber through the inlet port and discharging the fluid as a pressurized flow through the outlet port.

In one embodiment of the invention, the electromagnet and the pump casing are fixed in position so that the pressure rise and volumetric flow rate of the pump are defined by the frequency of reciprocation of the diaphragm, typically sixty cycles per second, and the displacement of the diaphragm for each reciprocating stroke. In another arrangement, the electromagnet and the pump casing are mounted within a pump housing for reciprocating movement in parallel with the direction of diaphragm movement. In this latter embodiment, the electromagnet and the casing are free to reciprocate toward and away from the permanent magnet and the diaphragm simultaneously with diaphragm reciprocation to increase the total expansion and contraction of the pumping chamber for each cycle, and thereby substantially increase volumetric pump output.

In another embodiment of the invention, two of the fluid pumps are mounted with their electromagnets in back-to-back relation to form a dual pump assembly including oppositely disposed pumping chambers. When the electromagnets are coupled to a common source of alternating electrical current, the associated permanent magnets are repelled and attracted in phase with each other to displace their respective diaphragms in equal and opposite directions to pump fluid through the two pumping chambers with little or no vibration of the assembly. In this embodiment, the two pumping chambers are coupled via their respective inlet ports to a common fluid source, such as atmosphere, and the respective outlet ports are coupled to a common pressure fluid supply conduit to provide a relatively higher volume and higher pressure fluid pump.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE FIRST EMBODIMENT (FIGS. 1 THROUGH 3)

Figure 1:
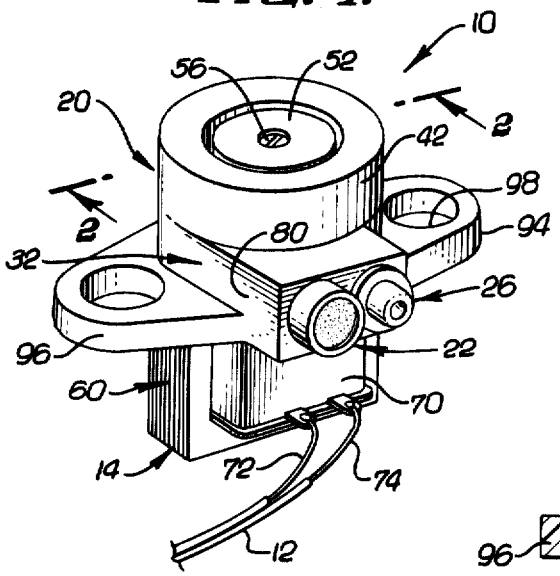
FIG. 1 is a perspective view illustrating an electromagnetic fluid pump embodying the novel features of this invention.

As illustrated in the drawings, the invention is embodied in an electromagnetic fluid pump indicated generally by the reference numeral 10 for pumping gaseous or liquid fluid. The principal intended use for the fluid pump 10 is to provide a supply of air under pressure to aerate water in an aquarium, whereby the invention will be described herein for use in pumping air. When used in this manner, the pump 10 typically is enclosed in a pump housing (not shown in FIGS. 1-3) positioned outside an aquarium and connected by an electric cord 12 to a source of alternating electrical current. A tube (not shown) is connected to an outlet of the pump to carry air into the aquarium and to discharge the air into the water, usually through a porous stone or other outlet device.

As in prior pumps for similar purposes, the fluid pump 10 of this invention has a driving element in the form of an electromagnet motor unit 14 having an electromagnet coupled by the cord 12 to a source of alternating electrical current to produce a magnetic field of reversing polarity. This reversing magnetic field reciprocates a driven pump element such as a diaphragm 16 closing one end of a pumping chamber 18 in a pump unit 20. Reciprocation of the diaphragm 16 alternately expands the volume of the pumping chamber to draw air into the chamber through an inlet port 22 and a one-way inlet valve 24 and contracts the volume of the pumping chamber to expel air therefrom through an outlet port 26 and a one-way outlet valve 28.

With the foregoing arrangement, the diaphragm 16 is rapidly reciprocated by the electromagnet motor unit 14 at the usual sixty cycles per second when the electromagnet is energized by common alternating electrical current. This rapid diaphragm reciprocation is effective to pump the air through the pumping chamber 18 and the outlet port 26 in substantially continuous flow with minute pulsations that are virtually imperceptible. However, while electromagnetic fluid pumps including electromagnet-powered pump elements have been used successfully for many years as aquarium pumps and for other purposes, such pumps have relied upon mechanical connections for coupling the electromagnet motor units to the diaphragms, as shown, for example, in U.S. Pat. No. 3,671,151.

In accordance with a primary aspect of the present invention, a permanent magnet 30 is mounted on the diaphragm 16 in close proximity with the electromagnet for alternate repulsion away from and attraction toward the electromagnet under the influence of the reversing magnetic field. This movement of the permanent magnet 30 reciprocates the diaphragm 16 to expand and contract the pumping chamber 18, thereby permitting the pump unit 20 to be of the simplest conceivable form in which the only major moving component is the diaphragm with the magnet mounted thereon. Importantly, the driving connection between the diaphragm 16 of the pump unit 20 and the electromagnet motor unit 14 is by magnetic forces alone.

In the preferred embodiments shown herein, the diaphragm 16 cooperates with a pump casing 32 to define the pumping chamber 18, with the pump casing 32 being provided in the form of a simplified and inexpensive molded cup formed from a suitable material such as plastic which is pervious to magnetic flux. The cup has a relatively thin bottom wall 34 which is secured by an adhesive or the like directly against the electromagnet motor unit 14, and an upstanding cylindrical side wall 36 defining a circular opening 38 over which the diaphragm 16 is mounted.

The diaphragm 16 is formed from a flexible material such as a natural rubber or synthetic elastomer to have a generally cup-shaped configuration fitting partially into the pumping chamber 18, and a circular outside shape defining a peripheral flange 40 with a downwardly opening groove 41 receiving the open upper end of the pump casing 32. The diaphragm thereby closes the opening 38 in the pump casing to provide a movable wall at the end of the pumping chamber generally opposite the bottom wall 34 of the casing. A retaining ring 42 having a generally inverted L-shaped cross-section fits downwardly and tightly over the diaphragm flange 40 and the open end of the pump casing to secure the diaphragm to the casing. As illustrated, in a preferred arrangement, this retaining ring 42 has an elongated outer skirt 44 sized for snug, mating engagement about a reduced diameter upper portion 46 of the casing side wall 36 to facilitate proper location and seating of the diaphragm flange. With a snug, friction fit, the retaining ring is relatively easily removable for servicing of the pump.

The central portion of the diaphragm 16 is sandwiched between an optional pair of relatively thin wear-resisting rings 48 and 50 clamped against opposite sides of the diaphragm between a pair of weights in the form of mounting plates 52 and 54 of a magnetizable material such as steel, with the permanent magnet being carried on the lower mounting plate 54 by a bonding adhesive or the like in a position within the pumping chamber 18. A screw 56 passes relatively loosely through the upper mounting plate 52 and through aligned openings in the wear rings 48 and 50 and the diaphragm 16 for threaded reception into a center hole 58 in the lower mounting plate 54 to clamp the plates in position and to mount the permanent magnet for movement with the diaphragm. Conveniently, both mounting plates are tapered toward the diaphragm to reduce possibility of damaging engagement with the diaphragm during operation of the pump.

The permanent magnet 30 is formed from a suitable permanent magnet material such as Alnico. The permanent magnet 30 is magnetized with one of its magnetic poles presented in a direction facing across the pumping chamber 18 toward the bottom wall 34 of the pump casing, and its other magnetic pole presented in a direction facing away from the casing bottom wall. With this orientation, the permanent magnet 30 is responsive to the reversing magnetic field provided by the electromagnet motor unit 14 to reciprocate the diaphragm 16 generally toward and away from the bottom wall of the pump casing.

Figure 2:
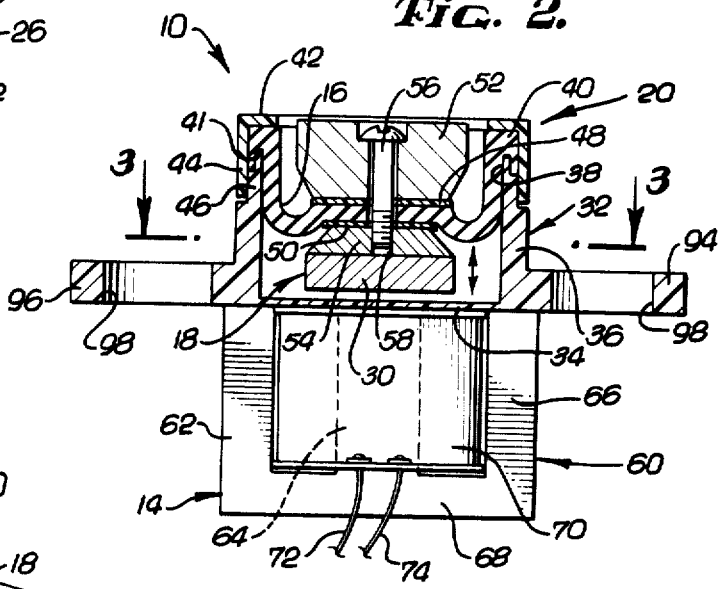
FIG. 2 is a vertical section taken generally along the line 2—2 of FIG. 1, with the electromagnet motor unit shown in front elevation.

The electromagnet motor unit 14 is secured to the bottom wall 34 of the pump casing 32, as described above, generally in opposition to the permanent magnet 30 at the other end of the pumping chamber 18. This electromagnet motor unit 14 includes the electromagnet in the form of a generally E-shaped magnetizable core 60 of laminated soft iron or the like having three core legs 62, 64, and 66 projecting upwardly, as illustrated in FIG. 2, from a lower crosspiece 68 to extend toward the bottom wall 34 of the pump casing. An electrical coil 70 is received about the center core leg 64 between the two outer core legs 62 and 66, and this coil 70 is adapted to be coupled to the source of alternating electrical current by a pair of conductive leads 72 and 74 which are insulated and joined together to form the electric cord 12. The bottom wall of the pump casing is thus secured to the electromagnet at the free ends of the three core legs 62, 64, and 66, whereby the poles of the electromagnet are oriented in alignment with the poles of the permanent magnet 30 within the pumping chamber 18.

When the electromagnet is energized by the alternating electrical current, the resulting magnetic field of reversing polarity acts through the pumping chamber 18 alternately to repel and attract the permanent magnet 30. This results in a reciprocating displacement of the diaphragm 16 along with the permanent magnet to alternately expand and contract the volume of the pumping chamber at a frequency corresponding with the frequency of the electrical current.

Figure 3:
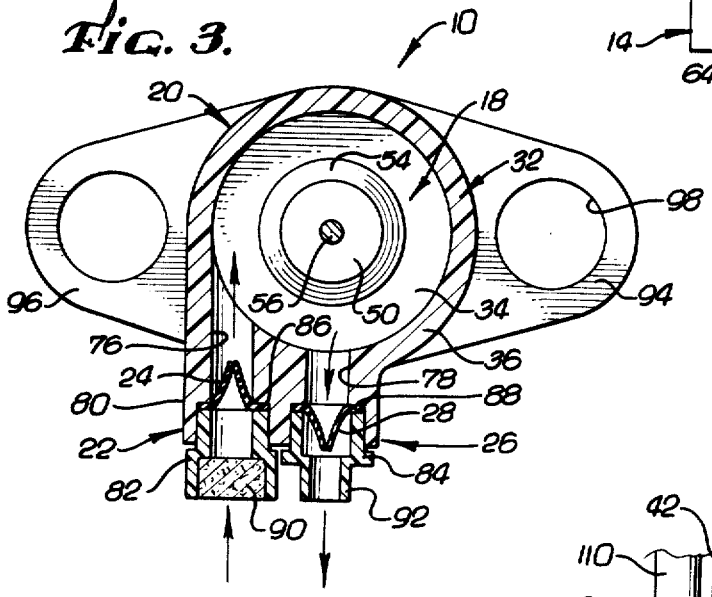
FIG. 3 is a horizontal section taken generally on the line 3—3 of FIG. 2.

As shown in FIGS. 1 and 3, the inlet and outlet ports 22 and 26 are formed by a pair of parallel passages 76 and 78, respectively, in a valve block 80 molded integrally with the side wall 36 of the pump casing 32. Each of these passages communicates with the pumping chamber 18, with the inlet passage 76 opening tangentially into the chamber and the outlet passage 78 opening generally centrally into the chamber.

While the one-way inlet and outlet valves 24 and 28 may take various forms, the presently preferred valves are so-called "duckbill" valves composed of flexible material and having bodies that taper from relatively wide inlet sides to narrow outlet sides that are slitted to form valve openings. Higher pressure at one of the inlet sides causes the valve to open and permit fluid to pass, while higher pressure beyond the outlet side tightly closes the valve. As can be seen in FIG. 3, the inlet valve 24 is mounted with its inlet side facing outwardly, and the outlet valve 28 is mounted with its inlet side facing inwardly. The two valves 24 and 28 are held in place by fittings 82 and 84 pressed respectively into enlarged outer ends of the passages 76 and 78 against mounting flanges 86 and 88 on the inlet ends of the valves. A porous filter element 90 is provided in the inlet fitting 82 to filter deleterious material from the fluid entering the pump, and the outlet fitting 84 includes a nipple 92 of reduced size for convenient connection to outlet tubing to carry fluid away from the pump.

A pair of mounting wings 94 and 96 project laterally from opposite sides of the pump casing 32, and each wing has a mounting hole 98 for reception of a mounting element for supporting the pump. These wings also are molded integrally with the pump casing and may be used to secure the pump immovably to a pump housing (not shown) or to mount the pump movably within a pump housing in a manner to be described in connection with the second embodiment shown in FIGS. 4 and 5.

In operation of the electromagnetic fluid pump 10, the magnetic field of reversing polarity provided by the electromagnet alternately repels and attracts the permanent magnet 30 to displace the diaphragm 16 and the associated mounting plates 52 and 54 away from and toward the electromagnet. Movement of the diaphragm away from the electromagnet expands the volume of the pumping chamber 18 whereby air is drawn into the pumping chamber through the one-way inlet valve 24. Conversely, movement of the diaphragm toward the electromagnet contracts the volume of the pumping chamber whereby the drawn-in fluid is expelled under pressure from the pumping chamber through the one-way outlet valve 28. This operation continues in rapid sequence according to the frequency of the alternating current, and as long as the electromagnet is coupled to the alternating current source.

The electromagnetic fluid pump 10 of this invention thus provides an effective pumping arrangement of highly simplified design and construction which is highly reliable and long lived in operation. The pump 10 has a single moving component, namely, the diaphragm carrying the permanent magnet, and this single moving component is reciprocated electromagnetically without any mechanical drive components or connections to assure quiet pump operation. Moreover, in the event of failure of the diaphragm, the diaphragm is conveniently located at one end of the pump where it can be quickly, easily, and inexpensively replaced by individuals unskilled in the design of fluid pumps.

Figure 4:
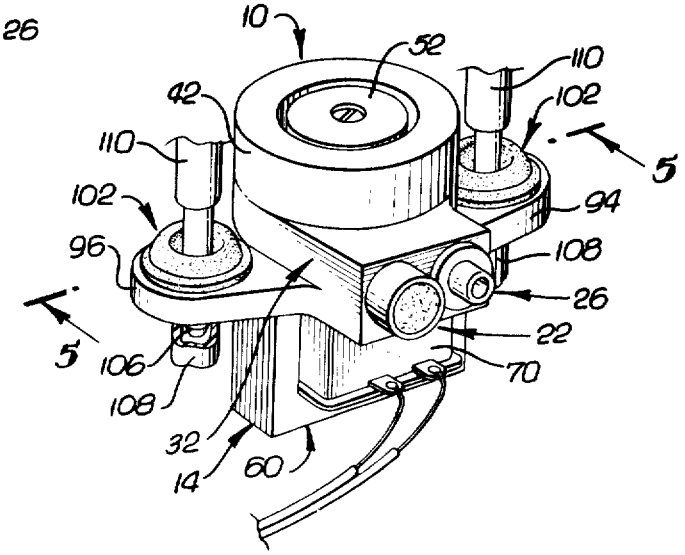
FIG. 4 is a fragmented perspective view illustrating a modified mounting arrangement for the fluid pump of the invention.
Figure 5:
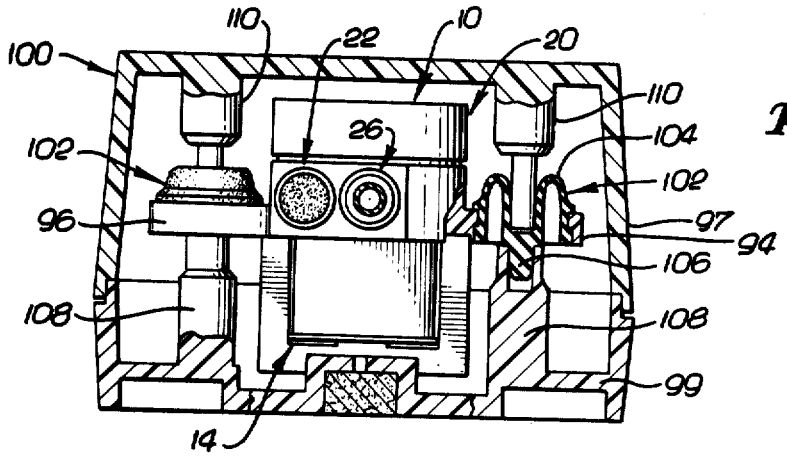
FIG. 5 is a front elevation view of the mounting arrangement of FIG. 4, with the pump movably supported within a pump housing shown in cross section.

DETAILED DESCRIPTION OF THE SECOND EMBODIMENT (FIGS. 4 and 5)

A modified mounting arrangement of the electromagnetic fluid pump 10 of FIGS. 1–3 is illustrated in FIGS. 4–5, with common reference numerals being used to refer to identical structural components. According to this mounting arrangement, the fluid pump 10 is movably supported within interfitting lower and upper halves 97 and 99 of an enlarged protective pump housing 100 to allow reciprocating displacement of the pump casing 32 and the electromagnet motor unit 14 in a direction opposite to the reciprocating displacement of the diaphragm 16.

More specifically, the outwardly projecting wings 94 and 96 on the pump casing 32 are adapted to receive flexible mounting diaphragms 102 within their respective mounting holes 98. Each mounting diaphragm 102 is formed from a suitable flexible diaphragm material and has its periphery appropriately secured to the associated wing 94 and 96 within the hole 98. Each diaphragm 102 includes an annular convolution 104 positioned between the associated wing 94 and 96 and an enlarged integral stud 106 at the center of the diaphragm 102. As shown best in FIG. 5, the stud 106 of each diaphragm 102 projects downwardly for seated reception into the upper end of a support post 108 secured to the housing lower half 99, whereby the pump 10 is supported resiliently with respect to the housing.

The lower support posts 108 cooperate with a pair of guide posts 110 which project downwardly from the housing upper half 97 to engage the mounting diaphragms 102 centrally with respect to their convolutions 104 to retain the diaphragm studs 106 seated within the underlying support posts 108. In this manner, the fluid pump 10 is movably supported within the housing 100 for movement with respect to the housing in a direction parallel with the support and guide posts 108 and 110 and in a direction parallel with the direction of reciprocation of the diaphragm 16.

When the electromagnet motor unit 14 shown in FIGS. 4 and 5 is coupled to a source of alternating electrical current the electromagnet alternately repels and attracts the permanent magnet within the pump casing 32 in the same manner as described with respect to FIGS. 1-3, resulting in pumping of air through the pump. Importantly, however, the resiliently mounted electromagnet and pump casing are free to reciprocate together within the housing 100 in opposition to the reciprocating permanent magnet 30. This reciprocation of the electromagnet 14 and the pump casing 32, when summed with the displacement of the diaphragm 16 and the permanent magnet 30, yields a substantial increase in the volumetric expansion and contraction of the pumping chamber 18 for each reciprocating cycle to increase substantially the volumetric pump output. If desired, the mounting plates 52 and 54 carried by the diaphragm 16 can provide selected masses chosen so that the total mass reciprocated by the diaphragm 16 corresponds with the combined mass of the electromagnet motor unit 14 and the pump casing 32, whereby the reciprocal displacements of the diaphragm 16 and the pump casing 32 are substantially equal and opposite.

Figure 6:
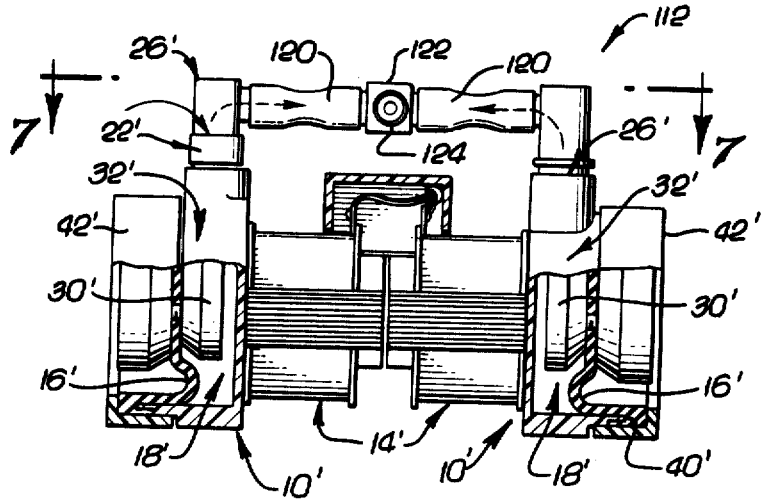
FIG. 6 is a front elevation view of an alternative embodiment of the invention in the form of a dual pump assembly, with portions broken away and shown in cross section.
Figure 7:
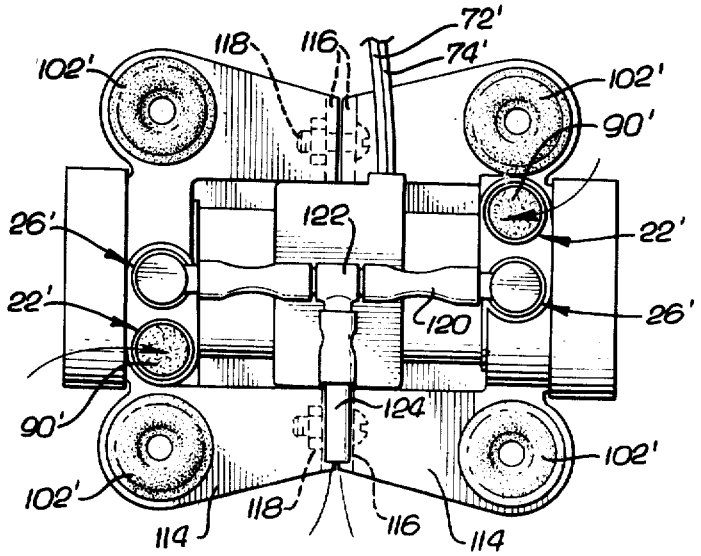
FIG. 7 is a top plan view of the embodiment of FIG. 6 taken generally along the line 7—7 of FIG. 6.

DETAILED DESCRIPTION OF THE THIRD EMBODIMENT (FIGS. 6 and 7)

An alternative embodiment of the invention is illustrated in FIGS. 6 and 7 wherein a pair of electromagnetic fluid pumps 10' are connected together to form a dual pump assembly 112. Since these two fluid pumps 10' are substantially identical to the fluid pump 10 shown and described in FIGS. 1-5, corresponding primed reference numerals are used herein for sake of clarity and continuity of description.

As illustrated in FIGS. 6 and 7, each of the two fluid pumps 10' includes an electromagnet motor unit 14' secured to a generally cup-shaped pump casing 32'. The open end of the casing is closed by a reciprocally driven pump element such as a diaphragm 16' which cooperates with the casing to define a pumping chamber 18' and which carries a permanent magnet 30'. As in the previous embodiment, a retaining ring 42' captures a peripheral flange 40' of the diaphragm 16' against the open end of the pump casing. Thus, the diaphragm 16' and associated permanent magnet 30' of each pump 10' are reciprocally movable to expand and contract the volume of the pumping chamber 18' when the electromagnet motor unit is coupled to a source of alternating electrical current. Such expansion and contraction of the pumping chamber 18' sequentially draws in air through an inlet port 22', and then expels the air through an outlet port 26'.

The two fluid pumps 10' are secured together in a back-to-back relation with their respective diaphragms 16' and permanent magnets 30' movable generally on a common axis. While the particular structure for back-to-back mounting of the pumps 10' does not form a part of the invention, one such structure comprises mounting flanges 114 projecting outwardly from opposite sides of the two pump casings 32', and these flanges 114 include downturned lips 116 which are fastened to the corresponding lips 116 of the other pump 10' by bolts 118. The mounting flanges 114 in turn provide convenient structure of use in mounting the dual pump assembly 112 within a pump housing (not shown) with flexible mounting diaphragms 102' movably supporting the assembly.

In operation, the two electromagnet motor units 14' of the pumps 10' are coupled to a common source of alternating electrical current by means of conductive leads 72' and 74'. The electromagnets of the motor units provide a magnetic field of continuously reversing polarity to repel and attract the associated permanent magnets 30'. Importantly, when the electromagnets are coupled to a common alternating current source, and the permanent magnets are oriented to be repelled and attracted in unison with each other. This results in displacement of the diaphragms 16' at the opposite ends of the assembly 112 in equal and opposite directions. In this manner, the reciprocal movements of the diaphragms cancel out each other to substantially reduce noise and vibration of the assembly during operation.

When the dual pump assembly 112 is adapted to pump air, such as in an environment for aerating aquarium water, the ports 22' of the two pumps 10' are both open to a source of air, such as atmosphere. If desired, filter elements 90' can be provided at the inlet ports 22' to prevent dirt or grit from entering the pumping chambers 18'. In addition, the two outlet ports 26' are advantageously coupled by relatively short lengths of branch tubing 120 for common supply of the pumped air to a "tee" fitting 122 which in turn is connected to a single outlet conduit 124. The air discharged under pressure from the two pumps 10' is thus combined to provide a single supply of pressurized air at a flow rate and pressure relatively higher than the flow rate and pressure of a single pump 10'.

The electromagnetic fluid pump of this invention therefore provides a highly reliable fluid pump having a simplified design and construction with a minimum number of moving parts. The pump is particularly suited for use in pumping air in an aquarium installation, as well as any other environment wherein prolonged life and quiet operation are desired in the relatively low pressure and low volume pumping of liquids and gases, with the masses of the mounting rings 52 and 54 being chosen to provide a selected fluid pressure output. The pump is capable of handling liquids or gases which are not incompatible with the materials from which the pump is formed, and the inclusion of the one-way inlet and outlet valves renders the pump self-priming when used for pumping liquid. Regardless of the environment in which the pump is used, the simplicity of design and construction renders the pump easily repairable, even by an individual unskilled in the fluid pump design in the event of pump failure.

A variety of modifications and improvements to the electromagnetic fluid pump of this invention are believed to be apparent to one skilled in the art. Accordingly, no limitation upon the invention is intended, except as set forth in the appended claims.

What is claimed is:

1. An electromagnetic fluid pump, comprising:

an electromagnet motor unit having an electromagnet with an E-shaped core and a coil fitting around a center leg of said core to be energized by a source of alternating current; and a pumping unit to be driven by said electromagnet motor unit, and comprising:

a cup-shaped plastic pump casing having an end wall disposed against said electromagnet, a side wall, an opening in its end opposite said end wall, and inlet and outlet ports opening into the interior of said casing, one-way valves permitting inlet and outlet fluid flows through said inlet and outlet ports, respectively, a flexible diaphragm secured to said casing over said opening at one end of the pump and cooperating with said casing to define a pumping chamber, at least one weight of a magnetizable material carried by said diaphragm, and a permanet magnet secured to said diaphragm to be reciprocated by said electromagnet from across said pumping chamber when the latter is energized, thereby alternating to attract and repel said permanent magnet to reciprocate said diaphragm in and out with respect to said pumping chamber to pump fluid through said chamber.

2. The electromagnetic fluid pump of claim 1 wherein said diaphragm has a cup-shaped configuration received at least partially into said casing, and wherein said permanent magnet is secured to said diaphragm within said pumping chamber.

3. The electromagnetic fluid pump of claim 2 wherein said at least one weight comprises a pair of mounting plates clamped against opposite sides of said diaphragm, said permanent magnet being secured to one of said mounting plates on its side opposite said diaphragm.

4. The electromagnetic fluid pump of claim 2 including a retaining ring for mounting said diaphragm with a friction fit with respect to said pump casing to close said opening at the end of the pumping chamber opposite said end wall.

5. The electromagnetic fluid pump of claim 1 wherein said one-way valves comprise an inlet valve along said inlet port for allowing passage of fluid into the pumping chamber when said diaphragm is reciprocated to expand the pumping chamber, and an outlet valve along said outlet port for allowing passage of fluid from the pumping chamber when said diaphragm is reciprocated to contract the pumping chamber.

6. The electromagnetic fluid pump of claim 5 wherein said inlet valve comprises a duckbill valve oriented to allow unidirectional passage of the fluid into the pumping chamber, and wherein said outlet valve comprises a duckbill valve oriented to allow unidirectional passage of the fluid from the pumping chamber.

7. The electromagnetic fluid pump of claim 1 including a filter mounted along said inlet port.

8. The electromagnetic fluid pump of claim 1 including means for fixing the position of said electromagnet and said pump casing with respect to each other.

9. The electromagnetic fluid pump of claim 1 including a relatively lightweight portable housing for receiving said electromagnet motor unit and said pumping unit, and support means for resiliently supporting said pump casing and said electromagnet with respect to said housing for reciprocal movement together in a direction corresponding with the direction of reciprocal movement of said diaphragm, whereby said permanent magnet and said electromagnet alternately repel and attract each other for reciprocation away from and toward each other to expand and contract the pumping chamber.

10. The electromagnetic fluid pump of claim 9 wherein said support means comprises a plurality of resilient mounting diaphragm members connected between said housing and said pump casing to accommodate reciprocating movement of said pump casing and said electromagnet.

11. The electromagnetic fluid pump assembly of claim 1 wherein said electromagnet and said permanent magnet are mounted with respect to each other to have magnetic poles presented to attract and repel each other.

12. An electromagnetic fluid pump assembly comprising:

a pair of electromagnetic fluid pumps, each of said pumps comprising an electromagnet to be energized by a source of alternating current, a cup-shaped pump casing mounted on said electromagnet, a resilient diaphragm closing the open end of the pump casing to define a pumping chamber, said diaphragm being reciprocally movable away from and toward said electromagnet for expansion and contraction of the pumping chamber, a permanent magnet carried by said diaphragm across the pumping chamber from said electromagnet for alternate repulsion and attraction by said electromagnet to reciprocate said diaphragm when said electromagnet is coupled to a source of alternating electrical current, and valve means for allowing passage of a fluid into the pumping chamber upon expansion of the pumping chamber and for allowing passage of the fluid from the pumping chamber upon contraction of the pumping chamber;

means for mounting said electromagnetic fluid pumps together with their electromagnets in a back-to-back relation with their respective diaphragms reciprocally movable away from and toward their associated electromagnets along a common axis and respectively positioned generally at opposite ends of the pump assembly; and means for coupling the fluid passing from the pumping chambers of said pumps upon contraction of the pumping chambers to a common pressure fluid supply conduit.

13. The electromagnetic fluid pump assembly of claim 12 wherein said mounting means comprises a mounting flange on said pump casing of each of said pumps, and means for connecting said mounting flanges to each other.

14. The electromagnetic fluid pump assembly of claim 12 wherein each of said pumps includes a fluid inlet port and a fluid outlet port, said valve means comprising a one-way inlet valve along said fluid inlet port and a one-way outlet valve along said fluid outlet port, and wherein said coupling means comprises a conduit coupled to said fluid outlet ports of said pumps.

15. The electromagnetic fluid pump assembly of claim 12 including means for coupling said electromagnets of said pumps to a common source of alternating electrical current, and wherein said permanent magnets of said pumps are oriented with respect to their associated electromagnets for reciprocation along said common axis in equal and opposite directions with respect to each other.

16. The electromagnetic fluid pump assembly of claim 12 wherein said electromagnet and said permanent magnet of each of said pumps respectively include magnetic poles presented to attract and repel each other.

17. The electromagnetic fluid pump assembly of claim 12 wherein each of said pumps further includes at least one weight of a magnetizable material carried by said diaphragm.

18. An electromagnetic fluid pump comprising:

a pump casing forming a pumping chamber;

an electromagnet at one end of said pump casing and operable when energized to produce a magnetic field of reversing polarity;

a pumping element at an opposite end of the pumping chamber and reciprocally movable away from and toward said electromagnet to expand and contract the pumping chamber;

a permanent magnet carried by said pumping element and having one of its poles facing across the pumping chamber toward said electromagnet for alternate repulsion and attraction by said electromagnet to reciprocate said pumping element; and one-way inlet and outlet valve means for admitting fluid into the pumping chamber as it is expanded and allowing discharge of fluid from the pumping chamber as it is contracted.

19. The electromagnetic fluid pump of claim 18 wherein said inlet valve means comprises means forming an inlet passage opening into the pumping chamber and a one-way valve along the inlet passage for allowing unidirectional fluid flow into the pumping chamber.

20. The electromagnetic fluid pump of claim 18 wherein said outlet valve means comprises means forming an outlet passage from the pumping chamber and a one-way outlet valve along the outlet passage for allowing unidirectional fluid flow from the pumping chamber.

21. The electromagnetic fluid pump of claim 18 wherein said pumping element comprises a convoluted flexible diaphragm.

22. The electromagnetic fluid pump of claim 21 including at least one weight of a magnetizable material carried by said diaphragm.

23. The electromagnetic fluid pump of claim 18 wherein said permanent magnet is disposed within the pumping chamber.

24. The electromagnetic fluid pump of claim 23 wherein said electromagnet and said permanent magnet each include a magnetic pole presented generally toward each other.

25. The electromagnetic fluid pump of claim 18 including means for fixing the position of said electromagnet and said pump with respect to each other.

26. The electromagnetic fluid pump of claim 18 including a relatively lightweight portable housing for receiving said pump casing and permanent magnet, and support means for resiliently supporting said pump casing and said electromagnet with respect to said housing for reciprocating movement together in a direction corresponding with the direction of reciprocal movement of said diaphragm, whereby said permanent magnet and said electromagnet alternately repel and attract each other to expand and contract the pumping chamber.

27. An electromagnetic fluid pump, comprising:

a pump casing defining a pumping chamber having one closed end and an opposite open end, said pump casing further including a fluid inlet port and a fluid outlet port for respective passage of a fluid into and from the pumping chamber;

an electromagnet mounted on said pump casing outside the pumping chamber with one of its magnetic poles adjacent to and presented toward said closed end of the pumping chamber;

a flexible diaphragm;

means for securing said diaphragm with respect to said pump casing to close the open end of the pumping chamber, said diaphragm being reciprocal away from and toward said electromagnet for respective expansion and contraction of the pumping chamber;

a permanent magnet mounted within the pumping chamber for movement with said diaphragm, said permanent magnet having one of its magnetic poles presented toward said electromagnet for alternate repulsion and attraction from across the pumping chamber by said electromagnet to reciprocate said diaphragm when said electromagnet is coupled to a source of alterating electrical current;

an inlet valve along said fluid inlet port for allowing passage of the fluid into the pumping chamber upon expansion of the pumping chamber; and an outlet valve along said fluid outlet port for allowing passage of a fluid from the pumping chamber upon contraction of the pumping chamber.

28. An electromagnetic fluid pump, comprising:

a relatively lightweight portable housing;

a pump casing forming a pumping chamber;

an electromagnet secured with respect to said pump casing adjacent one end of the pumping chamber;

a pumping element closing an opposite end of the pumping chamber and reciprocally movable away from and toward said electromagnet;

support means for resiliently supporting said pump casing and said electromagnet within said housing in a direction corresponding with the direction of reciprocal movement of said pumping element;

a permanent magnet carried by said pumping element for movement therewith, said permanent magnet and said electromagnet being alternately repelled from and attracted to each other when said electromagnet is coupled to a source of alternating electrical current for respective expansion and contraction of the pumping chamber;

one-way inlet valve means for allowing passage of a fluid into the pumping chamber when the pumping chamber is expanded;

and one-way outlet valve means for allowing passage of fluid from the pumping chamber when the pumping chamber is contracted.

29. The electromagnetic fluid pump of claim 28 wherein said pumping element comprises a flexible diaphragm, and including means for mounting said diaphragm on said pump casing.

30. The electromagnetic fluid pump of claim 28 wherein said permanent magnet is disposed within the pumping chamber.

31. The electromagnetic fluid pump of claim 28 wherein said electromagnet and said permanent magnet each include a magnetic pole presented to attract and repel each other.

32. An electromagnetic fluid pump assembly, comprising:

a pair of electromagnetic fluid pumps each including a pump casing defining a pumping chamber, an electromagnet at one end of the pumping chamber, a reciprocating pumping element closing an opposite end of the pumping chamber and movable away from and toward said electromagnet, a permanent magnet carried by said pumping element, a one-way fluid inlet port for passage of a fluid into the pumping chamber, and a one-way fluid outlet port for passage of the fluid from the pumping chamber;

means for mounting said pair of fluid pumps together in a back-to-back relation with their respective pumping elements disposed for reciprocal movement along a common axis and respectively positioned at opposite ends of the pump assembly; and means for coupling said electromagnets of said pair of fluid pumps to a common source of alternating electrical current for alternate repulsion and attraction of said permanent magnets to reciprocate said pumping elements away from and toward their associated electromagnets, and in opposite directions with respect to each other, for alternate expansion and contraction of the pumping chamber of said pumps respectively to draw the fluid into the pumping chambers and to expand the fluid from the pumping chambers.

33. The electromagnetic fluid pump assembly of claim 32 including means for coupling the fluid passing from the pumping chambers of said pumps upon contraction of the pumping chambers to a common pressure fluid supply conduit.

34. The electromagnetic fluid pump assembly of claim 32 wherein said mounting means comprises a mounting flange on said pump casing of each of said pumps, and means for connecting said mounting flanges to each other.

35. The electromagnetic fluid pump assembly of claim 32 wherein said fluid inlet and said fluid outlet ports of each of said pumps respectively include a one-way inlet valve along said fluid inlet port and a one-way outlet valve along said fluid outlet port.

36. The electromagnetic fluid pump assembly of claim 32 wherein said permanent magnets of said pumps have their magnetic poles oriented for reciprocation in equal and opposite directions with respect to each other.

* * * * *